United States Patent [19]

Thomas

[11] 4,135,827

[45] Jan. 23, 1979

[54] ROTARY BLENDER

[76] Inventor: John M. Thomas, 219 Felton, Caldwell, Id. 83605

[21] Appl. No.: 786,110

[22] Filed: Apr. 11, 1977

[51] Int. Cl.[2] ..... B01F 9/02

[52] U.S. Cl. ..... 366/141; 366/150; 366/228

[58] Field of Search ..... 259/3, 14, 30, 50, 81 R, 259/89, 90; 68/210, 144; 51/164; 134/159; 15/90; 366/54, 60, 61, 62, 63, 220, 228, 93, 57, 150, 141, 183

[56] References Cited

U.S. PATENT DOCUMENTS

| | | | |
|---|---|---|---|
| 779,010 | 1/1905 | St. Jean | 366/93 |
| 830,615 | 9/1906 | Rankin | 259/81 R X |
| 1,209,844 | 12/1916 | Juilfs | 366/54 |
| 1,486,686 | 3/1924 | Roecker | 366/93 |
| 1,799,520 | 4/1931 | Lauterbur et al. | 259/3 |
| 3,177,592 | 4/1965 | Meyer | 68/210 X |
| 3,712,090 | 1/1973 | Toth et al. | 68/210 |
| 3,861,654 | 1/1975 | Singleton | 259/89 |
| 3,869,883 | 3/1975 | Rotter | 68/210 X |

*Primary Examiner*—Philip R. Coe

*Attorney, Agent, or Firm*—Criddle, Thorpe & Western

[57] ABSTRACT

A rotary blender rotating about a horizontal axis having an elongate opening and a gate which may be hydraulically operated to open or close said opening. The blender may be loaded through the opening from the top by a hopper or front loading machine and the blended material may be discharged from the opening when the blender is stopped with the opening in an inverted position. Lifting vanes fastened to the inside of the blender in an offset V position rapidly mix particulate material as the blender is rotated.

7 Claims, 5 Drawing Figures

ROTARY BLENDER

BACKGROUND OF THE INVENTION

This invention relates to a rotary blender for particulate material. More specifically this invention relates to a blender having an opening sufficiently wide that it can be loaded from a front loading scoop attached to a tractor or the like.

The concept of utilizing rotary blenders for blending particulate materials such as fertilizers has long been known. However most blenders have to be loaded from a hopper which requires additional storage facilities and space. In addition most prior art blenders do not provide a homogeneous mixture and even if they do they require a mixing time of several minutes. Because of the size and position of the opening in currently marketed rotary blenders they are unsuitable for loading with a front end loader mounted on a tractor or other vehicle.

OBJECTS AND BRIEF DESCRIPTION OF THE INVENTION

It is an object of the present invention to provide a rotary blender wherein the components to be blended are loaded from the top and discharged from the bottom through the same opening.

It is also an object of this invention to provide a rotary blender rotatable about a horizontal axis which has an opening substantially the same length as the blender body.

It is a further object of the present invention to provide a rotary blender wherein the opening may be hydraulically opened or closed by a gate cover.

A still further object of the present invention is to provide a rotary blender having relatively wide lifting vanes attached to the inside thereof and do not spiral which operate to rapidly blend particulate matter into a homogeneous mixture as the blender is rotated.

These and other objects may be obtained by use of a blender rotatable about a horizontal axis. Preferably the blender is cylindrical in shape in the area opposite the gate opening terminating in side walls at right angles to each other leading to the gate opening which gate opening has protruding lips around the sides thereof against which the gate may rest when in a sealed or closed position. Endwalls are welded or otherwise secured to the blender body to complete the blender shell. Off centered relatively wide V shaped lifting vanes which do not spiral are secured to the cylindrical position of the blender wall. A shaft sealed to the blender shell housing extends lengthwise across the geometric center of the blender from one end to the other ending with trunions at either end being journaled into bearings in mounting blocks attached to the blender framework. A drive assembly is connected to one end of the shaft consisting of a motor, coupling, gear reducer, drive sprocket, driven sprocket chain and chain guard and serves to rotate the blender about the center shaft.

A shaft extends lengthwise across the blender and serves as the axis of rotation for the hydraulically operated gate. Obviously the lower end of the gate side is pivotally attached to the end of the blender at this point. The ends of the blender may be strengthened by angle irons or the like. Preferably such reinforcing serves as a point of attachment of one end of a hydraulic gate cylinder with the other end being attached to one edge of the gate side. By appropriate tubing hydraulic fluid is pumped into the cylinders on either end of the blender and the gate is opened. If the blender is stopped in a loading position the blender may rotate slightly to meet the slanted floor of a loading platform and the gate will move in the opposite direction the blender is rotated allowing a maximum opening for loading.

The loading platform may or may not be included in the invention. The platform is attached to extensions of the blender support frame and will ordinarily be tilted away from the opening. However when the gate is opened in a loading position a hydraulic cylinder may be actuated to form a downwardly slanting platform having sides extending upwardly at right angles. The forward edge of the platform is slightly above and may even overlap the opening. The platform is approximately the same width as the opening and is especially useful when using a front loader. Obviously the blender could be filled by other means such as by a hopper.

In order to make sure the blender is not overloaded or in the alternative receives an adequate load the frame is so constructed as to be mounted on load cells which electronically record the weight of material placed in the blender.

When the pump is reversed and the hydraulic fluid flows out of the cylinders the gate is firmly closed over the opening so that the blender can be rotated without the loss of any material. The speed of rotation and time of rotation may be varied. The blender is rotated in such a direction that the particulate material to be blended will fall from one side of an offset V shaped vane to the next side toward the center of the blender.

Whereas mixing times in the order of minutes have been required in previous devices it has been found that a homogeneous mixture may be obtained in as short a time as 30 seconds with the present blender.

When blending is completed the blender will be stopped with the gate at the bottom. Upon actuation of the hydraulic cylinders the gate will open and the blended contents will fall by gravity into a pit where the blended ingredients may be stored or moved by a conveyor belt, auger or other suitable means.

DRAWINGS OF THE INVENTION

FIG. 1 is a perspective view of the blender with the loading gate in an open position.

FIG. 2 is a top view of the blender shown in FIG. 1 showing the lifting vanes and the gate shaft and center shaft containing the axis of rotation for the loading gate and blender respectively.

FIG. 3 is a side view of the blender shown in FIG. 1 with the loading gate closed and the enclosed drive assembly shown in dotted form.

FIG. 4 is an opposite side view from FIG. 3 showing the loading gate in an open position.

FIG. 5 is a side view similar to FIG. 4 showing the blender in an inverted or unloading position.

DESCRIPTION OF THE DRAWINGS

There is shown in FIGS. 1 to 5 an operative embodiment of the invention. For the sake of simplicity the piping and tubing of the hydraulic and electrical system have not been shown as they are deemed to be obvious from the following description and are not necessary to adequately describe the invention.

There is shown in FIG. 1 a perspective view of the blender 10 mounted on a frame 11 consisting of four legs 12, 13, 14 and 15 interconnected by cross supports 16, 17, 18 and 19. Legs 12 and 13 are longer and slant inwardly to support additional members as will be hereinafter described. Mounted on cross supports 16, 17, 18 and 19 are load cells 20, 21, 22 and 23 which are responsive to the load placed into blender 10 and electronically register the weight of said load.

Figure 1:
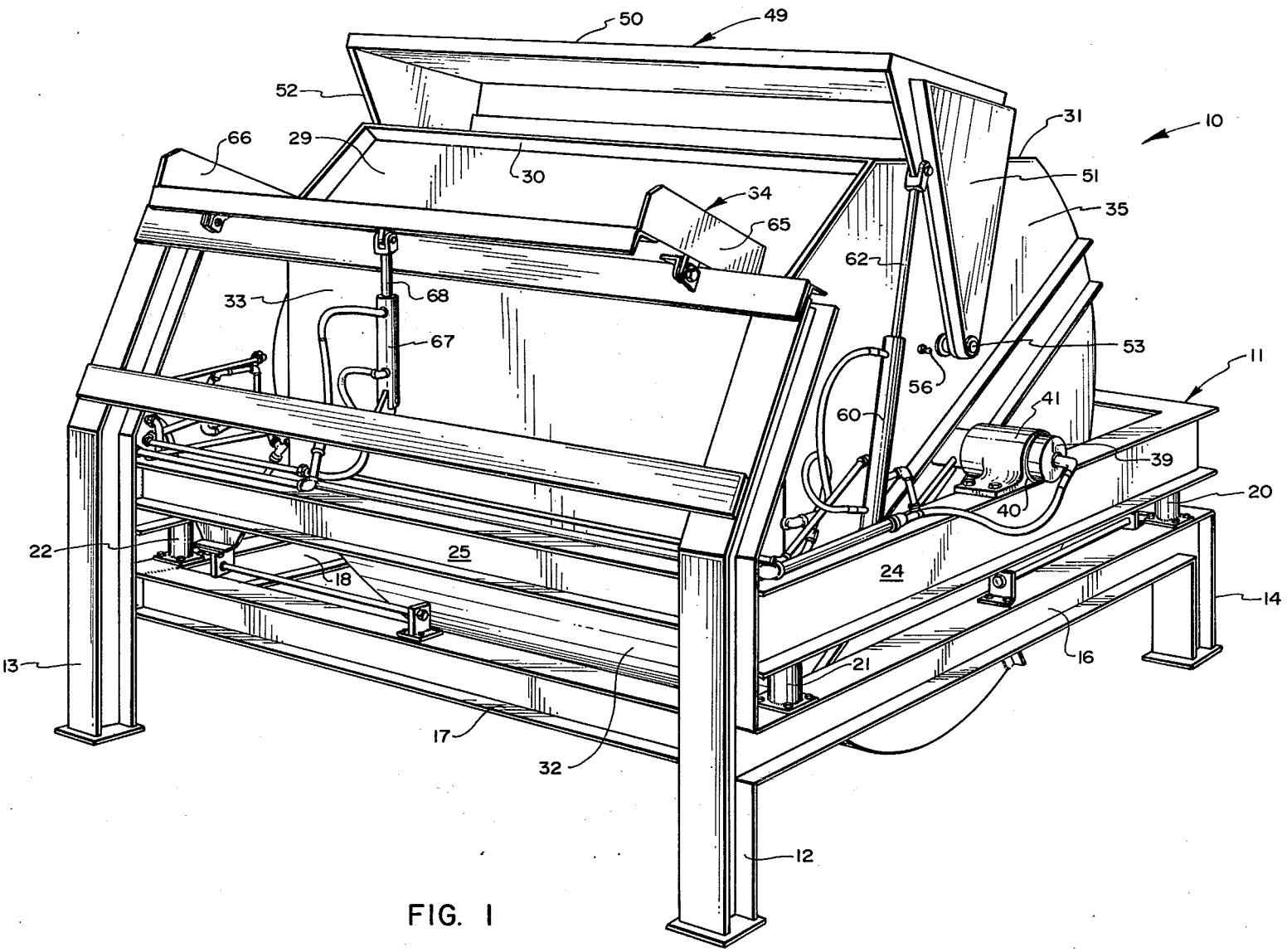

Additional horizontal framework pieces 24, 25, 26 and 27 are mounted on top of load cells 20, 21, 22 and 23 and serve as the load bearing structure for blender 10. The cross supports and horizontal framework are thus joined vertically through the load cells and horizontally by bolting, welding or other fastening means.

The blender 10 fits within the framework and consists of a sidewall 31 which is bent to meet desired specifications. Starting with the edge of opening 29 there is an upper protruding lip 30 followed by a straight sidewall 31 for a distance that is somewhat less than the blender radius. The wall then has a circular portion 32 about the geometric center of the blender. The circular portion area 32 follows through at least 180° and preferably between 180° and 220° depending upon the width of the opening 29. When even with what is to be the lower edge of opening 29 the sidewall 31 again becomes straight as sidewall portion 33 and is at right angles to sidewall 31. Sidewall 33 terminates with an outwardly protruding lip 34 which is in straight line relationship with lip 30. The distance between lips 30 and 34 defines the width of opening 29. On either end of the blender sidewall 29 is an endwall 35 and 36 exactly meeting the edges of the sidewall 23 and sealed thereto by welding of other non-leakable means. Preferably ends 35 and 36 are secured to sidewall 29 in a fluid tight relationship.

Figure 2:
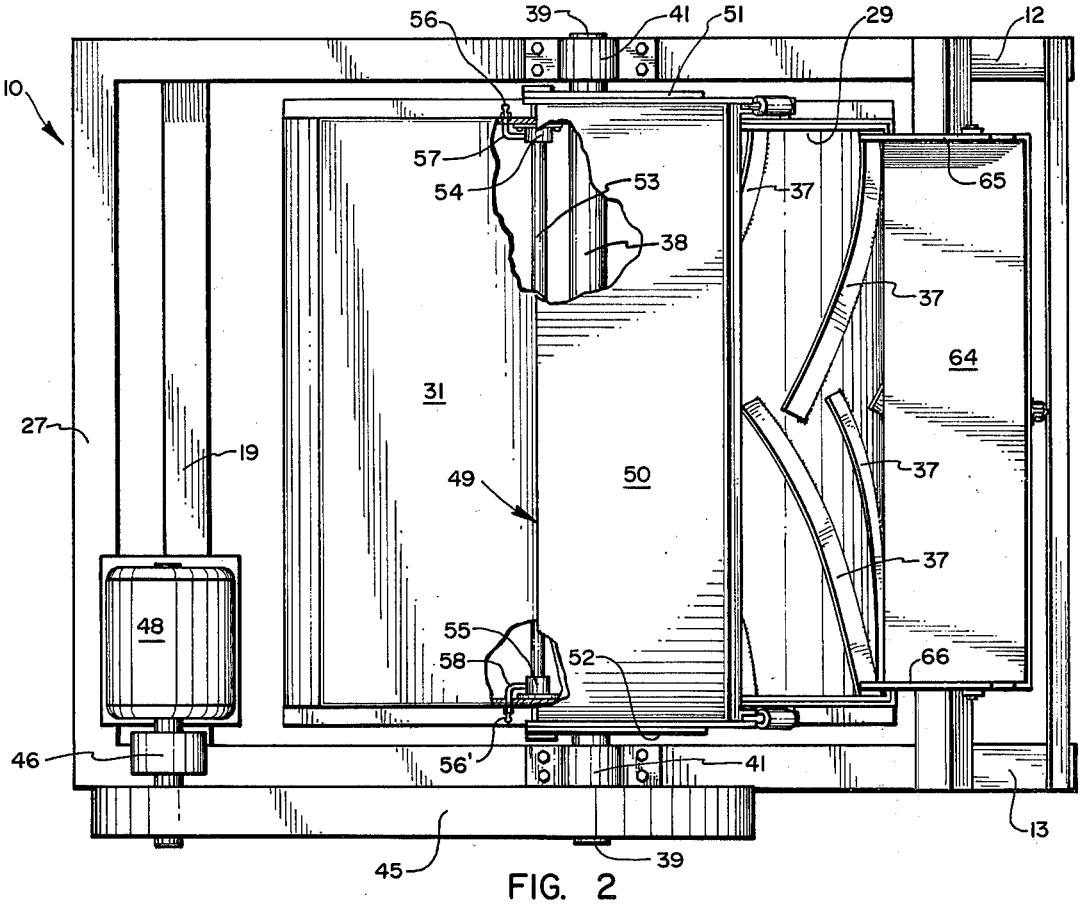

As illustrated in FIG. 2 the opening 29 runs the approximate length of the blender 10 and is at least long enough to accommodate a front end loader. The slanting V shaped lifting vanes 37 in an offset position which are attached to the circular portion 32 of the sidewall are also illustrated. The vanes are relatively wider and do not spiral as in a cement mixer. The particulate matter to be blended will flow down one vane toward the center onto the next vane which is slanted in the opposite direction. As the blender is rotated the vanes 37 cause a rapid and thorough mixing to take place in a short time. Particle attrition is reduced because of the gentle tumbling action and the shortness of time required for mixing.

FIG. 2 also shows two shafts running lengthwise across the blender. Shaft 38 extends through the geometric center of blender 10 and acts as the drive shaft to rotate the blender. Shaft 38 extends through apertures in end walls 35 and 36 which are then sealed by welding as other appropriate means. While not illustrated a hole in each end of the center shaft 38 serves as a means of attaching a hydraulic hose in a fluid tight relationship such that the shaft may rotate but the hose will not. A passageway, not shown, leads from the hole in the center of the shaft 38 inwardly and then outwardly to the surface of the shaft prior to the shaft's entrance into the endwalls 35 and 36. Proper hosing connects the other end of the passageway and leads to proper tubing and piping to supply hydraulic cylinders as hereinafter described.

Figure 3:
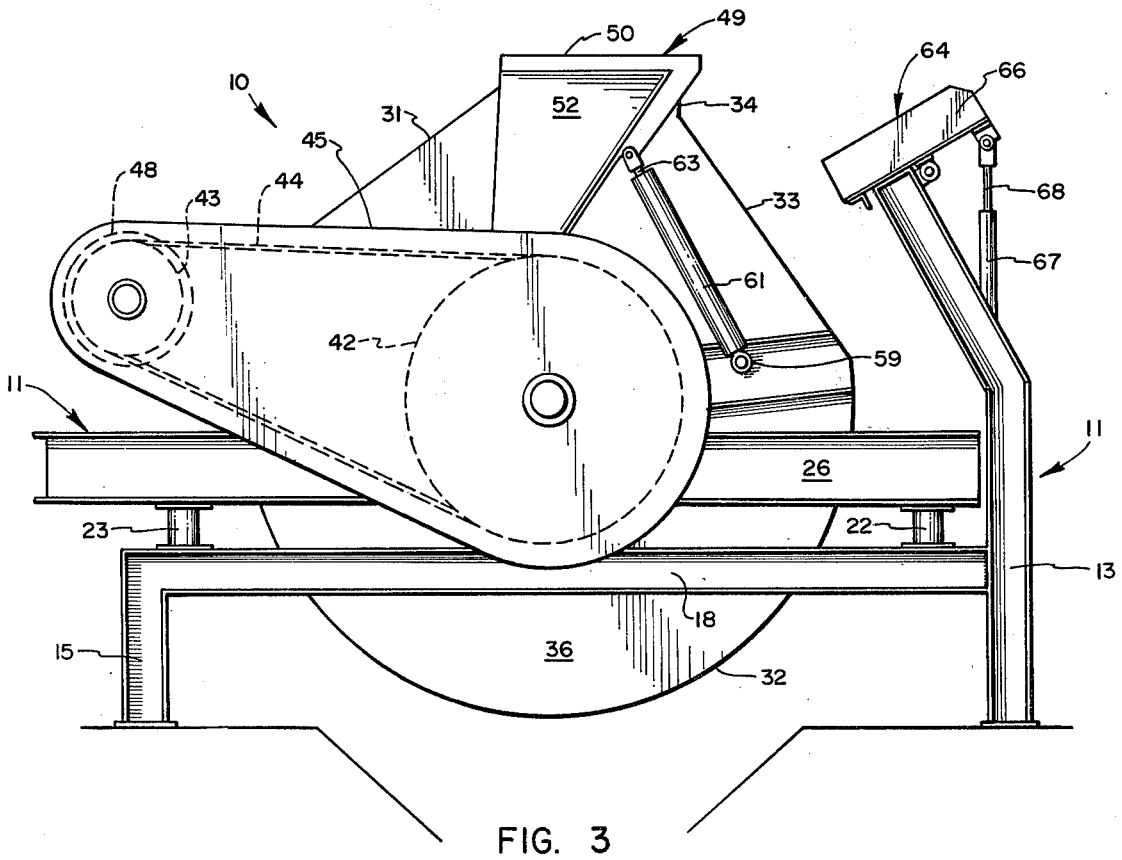
Figure 4:
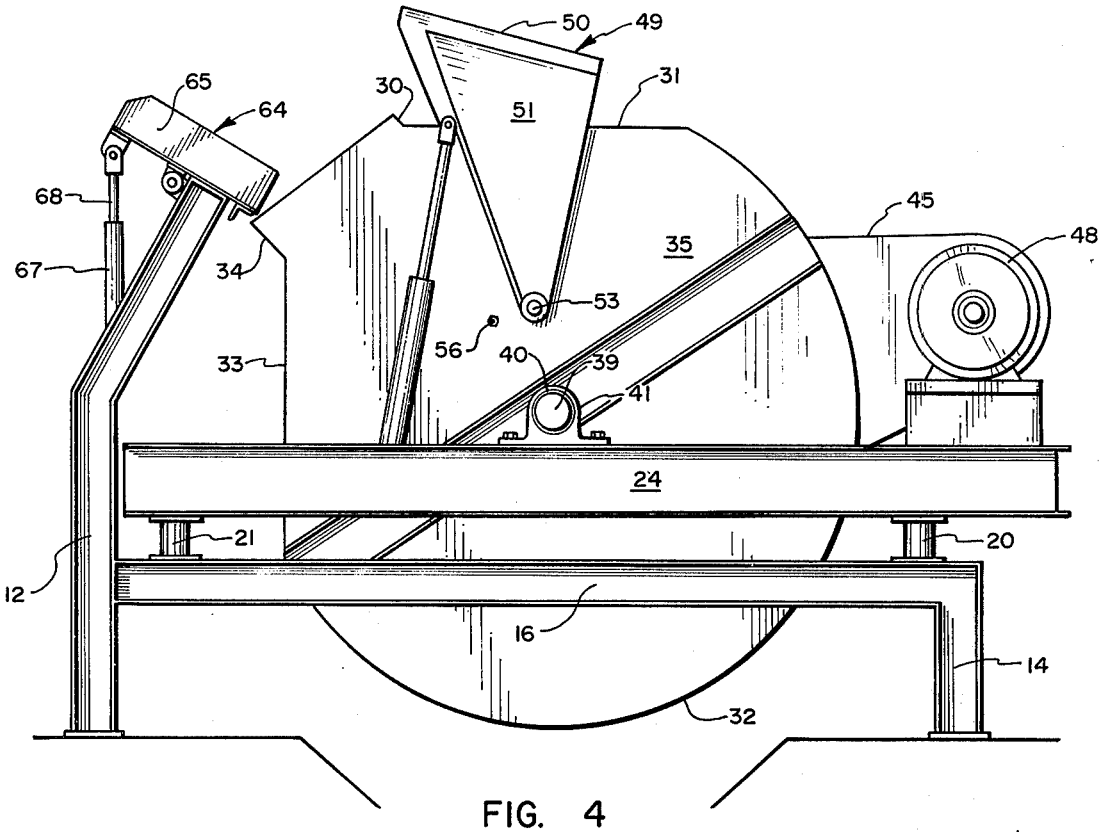
Figure 5:
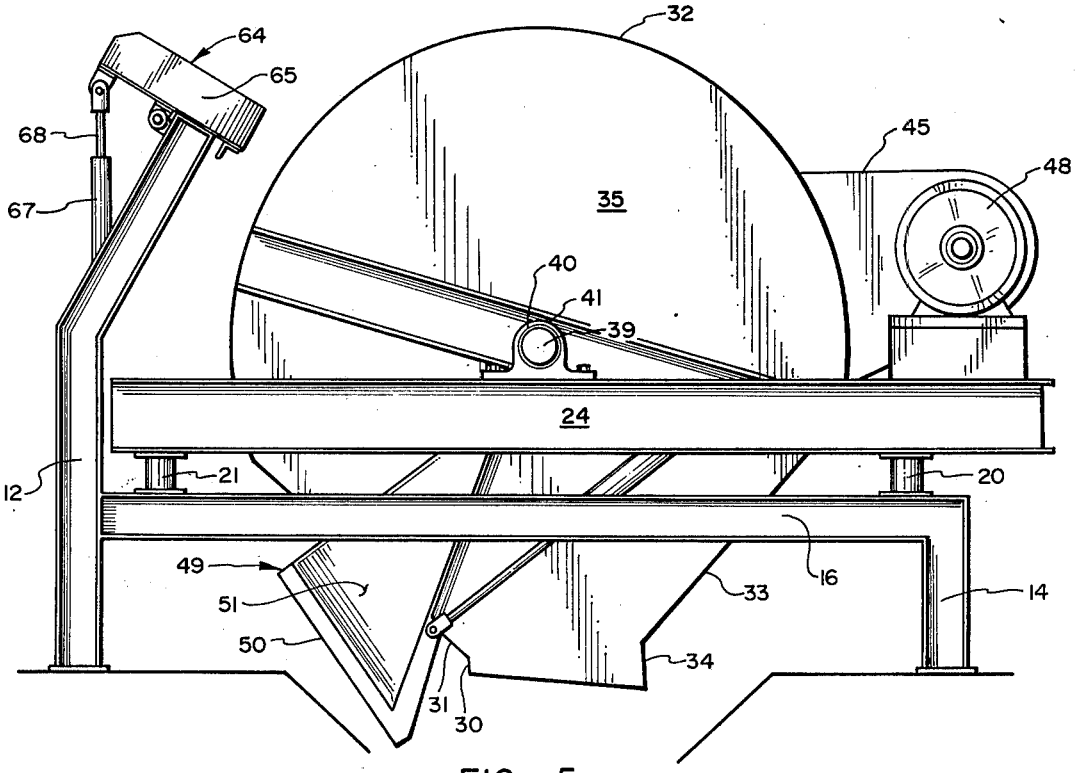

The shaft 38 ends in trunions 39 which are inserted into bearings 40 in pillow blocks 41 attached to framework 24 and 26. One trunion extends past the pillow block and has a drive sprocket 42 attached thereto. As shown in FIG. 3 the drive assembly consists of the driven sprocket 42 attached to a drive sprocket 43 which are interconnected by a chain 44 and covered by a chain guard 45. The remainder of the drive assembly consists of a gear reducer 46 attached by a coupling 47 to a motor 48.

The gate 49 consists of a roof or lid portion 50 with the edges on all four sides being bent upwardly at right angles. The lid 50 is sized to fit over opening 29 and may contain a gasket or other means to effectively seal the lid 50 over opening 29. Bolted or otherwise fastened to lid 50 are sides 51 and 52. Sides 51 and 52 are substantially triangular in shape and end at an apex containing an aperture and bearing into which gate shaft 53 may rotate. As shown in FIG. 2 gate shaft 53 extends through the body of blender 10 having the ends thereof journaled into the above mentioned bearings. Shaft 53 serves as the axis of rotation for gate 49. As shown in FIG. 2 gate 49 and shaft 53 rotate as the gate is opened or closed. Therefore the shaft 53 is encased at each inside end of the blender with a grease holding receptacle 54 and 55 which is connected to a grease fitting 56 and 56' feeding into receptacles 54 and 55 by tubes 57 and 58 to provide proper lubrication. Shaft 53 terminates with a trunion at each end journaled into a bearing in the blender endwalls.

As illustrated in FIG. 1 the endwalls may be strengthened or reinforced by angle iron or beams. Advantage may be taken of these reinforcements as a point of attachement 59 of one end of a hydraulic gate rotating cylinder 60 or 61 depending upon which side of the blender is being considered. The other end of the hydraulic cylinders 60 and 61 are attached to the edge of gate side 50 or 51 which is closest to the attaching member 59. Hydraulic fluid pumped through the passageways in the ends center shaft 38 enters the cylinders 60 and 61 forcing the piston rods 62 and 63 to extend thereby exposing the gate opening 29. Actually the cylinders 60 and 61 operate to slightly tilt or rotate blender 10 in one direction and gate 49 in the opposite direction to fully expose opening 29. Therefore when unloading the blender would be stopped with the gate a few degrees from being in a completely inverted position. Upon actuation of the cylinders 60 and 61 the blender would rotate and the gate would open allowing opening 29 to be completely inverted to discharge its contents into a pit hole or tunnel covered by a grating to be removed by a conveyor, auger or the like.

There are alternative loading mechanisms. If loaded from a hopper the gate 49 is opened exposing opening 29 which can then be filled to the proper weight as indicated by the load cells. A more practical means of loading and one which requires less space is by use of a front end loader attached to a tractor or similar vehicle.

When using a front loader a loading platform 64 is preferably used. The loading platform 64 is pivotally attached to angled legs 12 and 13 as shown in the accompanying drawings. Loading platform 64 has upwardly bent or angled outside edges 65 and 66. Platform 64 is substantially the same width as opening 29. Attached to the framework at one end and to the underside of the outer edge of platform 64 is a hydraulic cylinder 67. Again for the sake of simplicity the tubing and pipes carrying the hydraulic fluid are not shown. When the cylinder is closed the platform 65 is tilted away from the blender body 10. However when the blender body is in a loading position the piston rod 68 of cylinder 67 extends pivoting the platform 64 in a downward position. Platform 64 becomes even with or slightly overlaps the lower lip 34 of the opening. In this manner a front loader may discharge the particulate material into the opening 29 or onto platform 64 from which it will be discharged into opening 29. No known prior art blender provides for such ease in loading.

When the appropriate load has been placed in blender 10 as indicated by the load cells the hydraulic fluid is withdrawn from cylinders 60, 61 and 67 and the gate 49 is closed tightly against opening 29. Blender 10 can then be rotated by the drive means as previously described at the desired speed and for the desired length of time.

The lifting vanes 37 thoroughly mix the particulate matter, such as fertilizer, into a homogeneous mixture. When desired, as previously described the gate 49 will open in an inverted position discharging the contents and the blender may then be rotated back into a loading position.

The electrical details as well as the hydraulics have not been described in detail as they are within the skill of one having ordinary skill in the art. However it is believed that the gate, the size of the opening, allowing the use of a front loader due to the opening, the positioning of the lifting vanes and speed in mixing all contribute to a novel combination.

Although the invention as has been described is deemed to be that which would form the preferred embodiment of the blender, it is recognized that departures may be made therefrom without departing from the scope of the invention which is not limited to the details disclosed, but is to be accorded the full scope of the claims so as to include any and all equivalent devices and structures.

I claim:

1. A rotary blender for particulate material rotatable about a horizontal axis comprising:

(a) a framework;

(b) a blender mounted on said framework having two endpieces, an opening extending from one endpiece to the other, sidewalls extending at substantially right angles from each other from the opening and terminating in a circular sidewall wherein the endpieces and sidewalls are joined together into an integral unit;

(c) lifting vanes attached to the blender circular sidewalls in an overlapping, offset V position such that the material to be blended will be lifted by one vane and flow by gravity down the blender wall onto the next vane as the blender is rotated;

(d) a gate adapted to fit over said blender opening in a sealing relationship and removable therefrom, and (e) drive means to rotate said blender.

2. A rotary blender according to claim 1 wherein the gate is pivotally attached to each end of the blender and is hydraulically opened and closed.

3. A rotary blender according to claim 2 wherein the blender also contains a substantially flat loading platform of substantially the same length as the opening, and which is pivotal to adjoin the opening such that any material discharged onto said loading platform will flow into said opening.

4. A rotary blender according to claim 3 wherein the blender has an opening sufficiently large that it may be loaded by a front end scoop loader.

5. A rotary blender according to claim 2 wherein the portion of the framework, onto which the blender is mounted, is mounted onto electronic load cells which monitor the weight of material placed in the blender to be blended.

6. A rotary blender according to claim 2 containing means for stopping the blender with the opening in a substantially upright position with the gate opened for loading.

7. A rotary blender according to claim 2 containing means for stopping the blender with the opening in an inverted position with the gate open for unloading.

* * * * *